US006922543B2

(12) United States Patent
Kanagawa

(10) Patent No.: US 6,922,543 B2
(45) Date of Patent: Jul. 26, 2005

(54) IMAGE FORMING APPARATUS AND CLEANING UNIT

(75) Inventor: Takashi Kanagawa, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 6 days.

(21) Appl. No.: 10/628,310

(22) Filed: Jul. 29, 2003

(65) Prior Publication Data

US 2004/0109711 A1 Jun. 10, 2004

(30) Foreign Application Priority Data

Sep. 19, 2002 (JP) ..... 2002-273829

(51) Int. Cl.[7] ..... G03G 21/00
(52) U.S. Cl. ..... 399/350; 399/353
(58) Field of Search ..... 399/343, 345, 399/346, 350, 351, 353, 357; 15/256.5, 256.51, 256.52, 256.53

(56) References Cited

U.S. PATENT DOCUMENTS 5,812,919 A * 9/1998 Takano et al. ..... 399/312
6,060,205 A * 5/2000 Takeichi et al. ..... 430/126
6,760,562 B2 * 7/2004 Nishida et al. ..... 399/297

FOREIGN PATENT DOCUMENTS

| | | | |
|---|---|---|---|
| JP | 7-210051 | | 8/1995 |
| JP | 8-248776 | * | 9/1996 |
| JP | 8-262952 | * | 10/1996 |
| JP | 2001-051561 | | 2/2001 |
| JP | 2001-235987 | * | 8/2001 |

* cited by examiner

*Primary Examiner*—Hoan Tran
(74) *Attorney, Agent, or Firm*—Morgan, Lewis & Bockius LLP

(57) ABSTRACT

An image forming apparatus has a cleaning blade adapted to scrape off the residual toner adhering to the surface of the image carrier, a brush arranged upstream relative to the cleaning blade in the direction of revolution of the image carrier and adapted to apply solid lubricant to the surface of the image carrier, and a support member that supports a piece of solid lubricant and adapted to generate movement and to cause the solid lubricant to come into contact with the brush due to the generated movement.

20 Claims, 8 Drawing Sheets

*Prior Art*

*Prior Art*

*Prior Art*

IMAGE FORMING APPARATUS AND CLEANING UNIT

BACKGROUND OF THE INVENTION

1. Field of the Invention

The present invention relates to an image forming apparatus such as a printer, a copying machine or a facsimile machine using an electro-photographic system or an electrostatic recording system. More particularly, the present invention relates to an image forming apparatus having a rotary brush for applying lubricant to the surface of an image carrier. The present invention also relates to a cleaning unit for cleaning the surface of the image carrier in the image forming apparatus.

2. Description of the Related Art

FIG. 6 of the accompanying drawings schematically illustrates a known image forming apparatus of the type under consideration. Referring to FIG. 6, it is adapted to clean the surface of the image carrier (photosensitive drum) 15 of the apparatus by means of a cleaning unit 18 each time after transferring an image. More specifically, the residual toner on the surface of the image carrier 15 is scraped off by means of a cleaning blade 42 and, at the same time, a rotary brush 51 arranged upstream relative to the cleaning blade 42 in the sense of revolution of the image carrier 15 is brought into contact with solid lubricant 53 and driven to revolve in the sense of revolution indicated by an arrow in FIG. 6 at a rotary speed greater than that of the image carrier 15 to apply lubricant with a reduced contact resistance on the part of the cleaning blade 42. The toner adhering to the rotary brush 51 is removed by a flicker 54 and collected by a toner transporting auger 60.

Another known image forming apparatus uses a cleaning unit that is different from the above described one and adapted to fit solid lubricant to a support panel, guide the support panel by means of a brush cover and causes the support panel to contact with a rotary brush by its own weight (see, inter alia, Patent Document 1 listed below).

Still another known image forming apparatus uses a cleaning unit that is different from the above described ones and adapted to utilize a lubricant roller as solid lubricant and cause it to revolve and contact with a rotary brush (see, inter alia, Patent Document 2 listed below).

[Patent Document 1]

Japanese Patent Application Laid-Open Publication No. 7-210051 (page 1, FIG. 1)

[Patent Document 2]

Japanese Patent Application Laid-Open Publication No. 2001-51561 (page 1, FIG. 1)

However, the technique of FIG. 6 (and that of Patent Document 1) is accompanied by a problem as described below. The solid lubricant 53 can vibrate randomly in the axial direction of the rotary brush 51 and/or vertically as the rotary brush 51 is driven to revolve. Then, the rate of consumption of solid lubricant 53 will not uniform and can vary depending on the winding direction of the bristles of the rotary brush 51 so that, as time goes by, the cross section of left end part a of the solid lubricant 53 can become different from that of the right end part b thereof as shown in FIG. 7. As a result, solid lubricant 53 will be made to adhere to the rotary brush 51 at a varying rate. As solid lubricant 53 adheres to the rotary brush 51 at a varying rate, it is applied to the image carrier 15 also at a varying rate so that consequently the contact resistance of the cleaning blade 42 becomes uneven relative to the image carrier 15 in its axial direction. Then, the edge of the cleaning blade 42 can be worn unevenly and become nicked. Such a cleaning blade 42 can no longer effectively remove the residual toner on the image carrier 15 and clean its surface.

As the effect of cleaning the surface of the image carrier 15 becomes uneven, the film thickness of the image carrier 15 also becomes uneven as shown in FIG. 8. More specifically, in the illustrated instance, the film thickness of the image carrier 15 is reduced only slightly to a small extent w1 (and hence the film thickness t1 is large) at the part of the image carrier 15 that corresponds to the part of the solid lubricant 53 showing cross section 53*a*, whereas the film thickness of the image carrier 15 is reduced to a large extent w2 (and hence the film thickness t2 is small) at the part of the image carrier 15 that corresponds to the part of the solid lubricant 53 showing cross section 53*b*. As the image carrier 15 is worn unevenly in this way, the density of the image formed by means of the image carrier 15 also becomes uneven.

On the other hand, with the technique of Patent Document 2, a lubricant roller is driven to revolve and contact with a rotary brush. In other words, both the lubricant roller and the rotary brush require a mechanism for driving them to revolve so that the overall structure of the image forming apparatus becomes a complicated one. Additionally, the lubricant needs to be moved toward the rotary brush as the former is consumed and becomes slim. Then, the solid lubricant comes to be accompanied by the above identified problem of showing a cross section that varies between the left and right ends thereof as in the case of FIG. 6 and Patent Document 1.

SUMMARY OF THE INVENTION

The present invention has been made in view of the above circumstances and provides an image forming apparatus and a cleaning unit by which the solid lubricant can be held to show a constant pressure level by means of a simple arrangement so that the rotary brush can uniformly apply solid lubricant.

According to an aspect of the present invention, an image forming apparatus adapted to form a fixed toner image on a recording medium by forming a toner image on an image carrier, transferring the toner image onto the recording medium and fixing the transferred toner image has a cleaning blade, a brush and a support member explained as follows.

The cleaning blade is adapted to scrape off the residual toner adhering to the surface of the image carrier. The brush is arranged upstream relative to the cleaning blade in the sense of revolution of the image carrier and adapted to apply solid lubricant to the surface of the image carrier. The support member revolvably supports the solid lubricant and adapted to generate movement, and also adapted to cause the solid lubricant to come into contact with the brush due to the movement.

An image forming apparatus according to the present invention causes the brush to contact with solid lubricant, drives the brush so as to revolve and apply lubricant to the image carrier and scrapes off the residual toner on the surface of the image carrier by means of the cleaning blade, reducing the contact resistance of the cleaning blade. Since the support member supporting the solid lubricant is prevented from moving in any directions except the peripheral direction, the solid lubricant is allowed to nip (bite) the brush always to a given constant extent so that solid lubricant is consumed at a constant rate and made to adhere to the brush also at a constant rate. As a result, the solid lubricant is applied to the image carrier always at a constant rate.

Additionally, since the support member supporting the solid lubricant is adapted to generate movement, it is possible to keep the solid lubricant contacting with the brush under predetermined contact pressure due to the movement and prevent the solid lubricant from moving randomly and jumping up and down in response to the rotary movement of the brush. Thus, solid lubricant can be supplied on a stable basis for a prolonged period of time due to the predetermined constant contact pressure.

In the image forming apparatus in the aspect, it is preferable that the support member is revolvably supported by way of a rotating shaft being parallel with the brush.

Also, the support member may include a plate-shaped support section that supports the solid lubricant and a rotating shaft. The rotating shaft is supported by the support section and provided at a position for causing the solid lubricant to generate the movement.

Further, the support member may support the solid lubricant, so that the solid lubricant is arranged upstream in the direction of gravity of the brush and comes into contact with the brush due to the movement generated by the weight of both of the support member and the solid lubricant themselves.

The support member may support the solid lubricant and have a hole provided at a position for causing the solid lubricant to generate the movement. The hole in this case receives and revolvably supports the rotating shaft.

The support member may be provided with a twisted coil spring in order to increase the movement and to apply predetermined constant contact pressure.

A press spring may be provided to press the support member or a weight may be fixed on the support member in order to apply predetermined constant contact pressure to the support member.

Thus, as described above, according to the present invention, since the support member supporting the solid lubricant is prevented from moving in any directions except the peripheral direction, the solid lubricant is allowed to nip the brush always to a given constant extent without deviations in the axial direction of the brush and hence it is consumed at a constant rate over the entire service area so that consequently solid lubricant adheres to the brush always by a given constant amount per unit time and hence is applied to the image carrier always at a constant rate. Therefore, the edge of the cleaning blade will be worn uniformly and hence can hardly become nicked. Such a cleaning blade can enjoy a long service life and effectively and reliably remove the residual toner on the image carrier. Furthermore, since the film of the image carrier is axially worn at a constant rate, the quality of the image formed by an image forming apparatus according to the present invention is stabilized.

Additionally, since the support member supporting the solid lubricant is adapted to generate movement, it is possible to keep the solid lubricant contacting with the brush under predetermined contact pressure due to the movement and prevent the solid lubricant from moving randomly and jumping up and down in response to the rotary movement of the brush. Thus, solid lubricant can be supplied on a stable basis for a prolonged period of time due to the predetermined constant contact pressure.

According to another aspect of the present invention, an image forming apparatus adapted to form a fixed toner image on a recording medium by forming a toner image on an image carrier, transferring the toner image onto the recording medium and fixing the transferred toner image, has a cleaning part, a lubricant-applying part, and a supporting part, as explained below.

The cleaning part scrapes off the residual toner adhering to the surface of the image carrier. The lubricant-applying part is arranged upstream relative to the cleaning part in the direction of revolution of the image carrier, and applies solid lubricant to the surface of the image carrier. The supporting part revolvably supports the solid lubricant and is adapted to generate movement, and also supports the solid lubricant to come into contact with the lubricant-applying part due to the movement.

In the image forming apparatus according to this aspect, the lubricant-applying part may have a rotating shaft, and the supporting part may be revolvably supported by way of the rotating shaft being parallel with the lubricant-applying part.

Also, the supporting part may have a plate-shaped support section that supports the solid lubricant and a rotating shaft that is supported by the support section and provided at a position for causing the solid lubricant to generate the movement.

The supporting part may support the solid lubricant so that the solid lubricant is arranged upstream in the direction of gravity of the lubricant-applying part and comes into contact with the lubricant-applying part due to the movement generated by the weight of both of the supporting part and the solid lubricant themselves.

The supporting part may also support the solid lubricant and include a hole provided at a position for causing the solid lubricant to generate the movement. The hole in this case receives and revolvably supports a rotating shaft.

According to another aspect of the present invention, a cleaning unit for applying to an image forming apparatus to form a toner image on a recording medium by forming a toner image on an image carrier, transferring the toner image onto the recording medium has a cleaning section, a support section, and a brush section as explained below.

The cleaning section contacts the image carrier to clean the residual toner on the image carrier. The support section has a rotate member for rotating the support section and a holding member for holding a solid lubricant. The brush section contacts the solid lubricant and the image carrier to supply a piece of the sold lubricant on the image carrier.

The support section in this aspect may be revolvably supported by way of a rotating shaft being parallel with the brush section.

Also, the support section may include a plate-shaped support section that supports the solid lubricant and a rotating shaft being supported by the support section and provided at a position for causing the solid lubricant to generate the movement.

The support section may support the solid lubricant to be arranged upstream in the direction of gravity of the brush section, and support the solid lubricant to come into contact with the brush section due to the movement generated by the weight of both of the support section and the solid lubricant themselves.

The support section may further support the solid lubricant and include a hole being provided at a position for causing the solid lubricant to generate the movement. The hole in this case receives and revolvably supports a rotating shaft.

It is also acceptable that the support section is provided with a section to increase the movement.

BRIEF DESCRIPTION OF THE DRAWINGS

Preferred embodiments of the present invention will be described in detail based on the following figure, wherein.

DESCRIPTION OF THE PREFERRED EMBODIMENTS

Now, the present invention will be described in greater detail by referring to the accompanying drawings that illustrate preferred embodiments of the invention.

Figure 1:
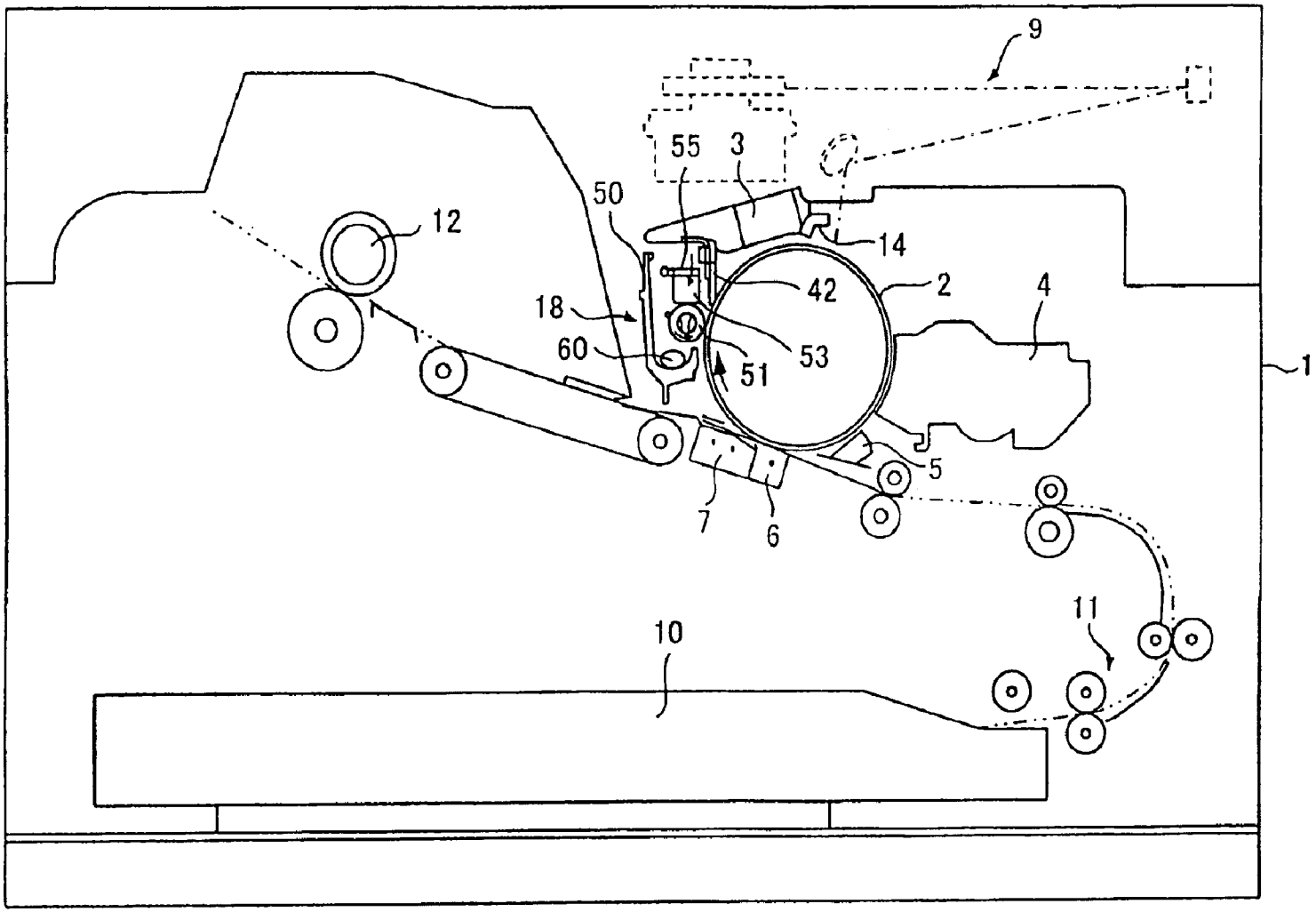
FIG. 1 is a schematic lateral view of an embodiment of image forming apparatus according to the present invention, showing its entire configuration.

FIG. 1 is a schematic lateral view of an embodiment of image forming apparatus according to the present invention, showing its entire configuration.

Referring to FIG. 1, the apparatus main body 1 is provided with an image carrier 2, around which there are arranged sequentially a primary charger 3, a developing unit 4, a pre-transfer charger 5, a transfer charger 6, a separation charger 7, and a cleaning unit 18. The surface of the image carrier 2 is uniformly charged with electricity by the primary charger 3 and subsequently exposed to light by an image exposing mechanism 9 to form an electrostatic latent image, which electrostatic latent image is developed by the developing unit 4 into a visible image, which visible image is then transferred onto a sheet of paper by the transfer charger 6 that is being transported from the inside of a sheet tray 10 toward the image carrier 2 by means of a sheet feeding mechanism 11. If the image forming apparatus is a copying machine, the operation of copying an originally image is completed when the sheet of paper is sent to a fixing unit 12 and the image on the sheet of paper is fixed there.

The image exposing mechanism 9 is of the laser type and has a laser oscillator, a rotary mirror and a plurality of mirrors. It is adapted to expose the image carrier to light so as to cause it to bear an image according to the image information it receives from external OA equipment.

The primary charger 3 and the cleaning unit 18 are realized in the form of cartridges fitted to the housing 50 of the image forming apparatus that can be taken out of the apparatus main body 1 and remounted onto it. As will be described in greater detail hereinafter, the housing 50 contains therein a cleaning blade 42, a rotary brush 51, a piece of solid lubricant 53, an auger 60 and so on. After the completion of the transfer step of transferring a toner image, the surface of the image carrier 15 is cleared of the residual toner and the paper debris that have been remaining there by means of the cleaning unit 18 in order to make it ready for the next image forming process.

Figure 2:
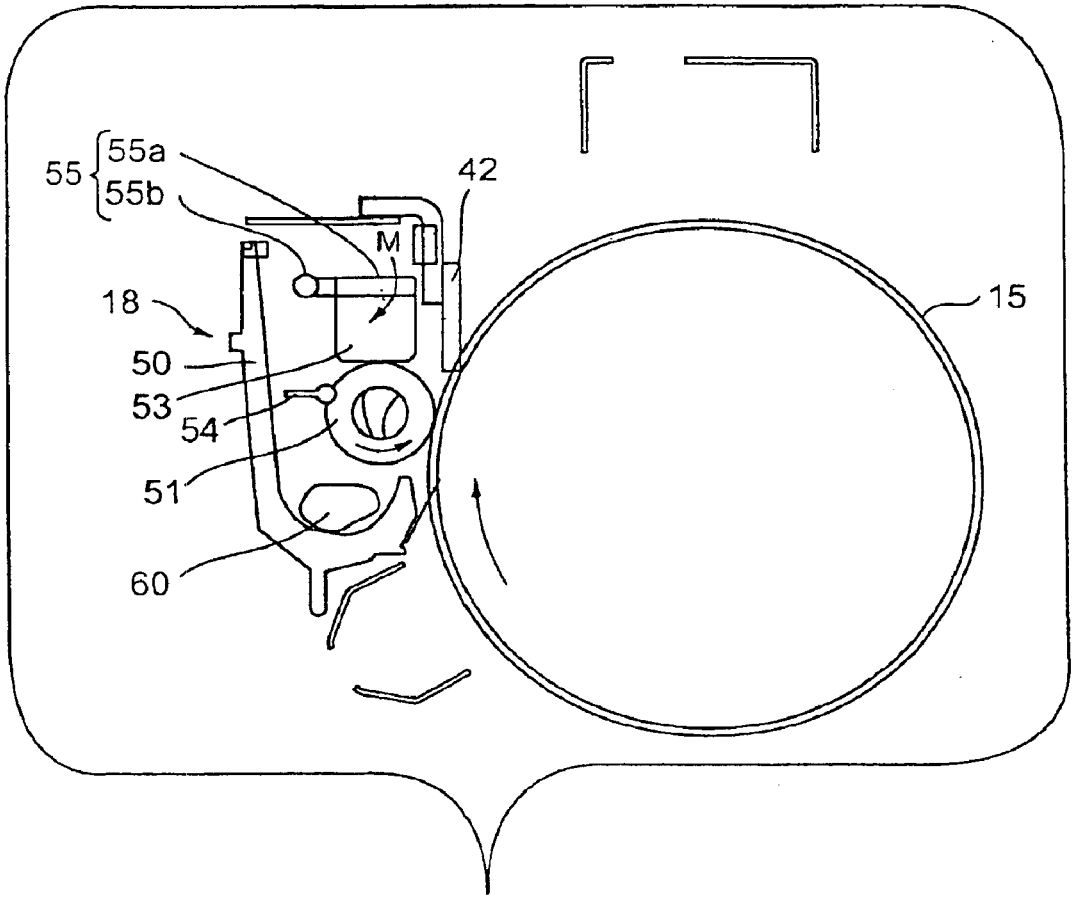
FIG. 2 is a schematic lateral view of the cleaning unit of the embodiment of image forming apparatus FIG. 1, showing the unit in detail.

FIG. 2 shows the image carrier 15 and the cleaning unit 18 of the embodiment of image forming apparatus FIG. 1, showing them in detail.

Referring to FIG. 2, the cleaning unit 18 includes a cleaning blade 42 fitted to a front part of the housing 50, a rotary brush 51 arranged upstream relative to the cleaning blade 42 in the sense of revolution of the image carrier 15 and a piece of solid lubricant 53 that is held in contact with the rotary brush 51. Solid lubricant 53 is applied to the image carrier 15 by means of the rotary brush 51 so as to reduce the contact resistance of the cleaning blade 42.

Figure 3:
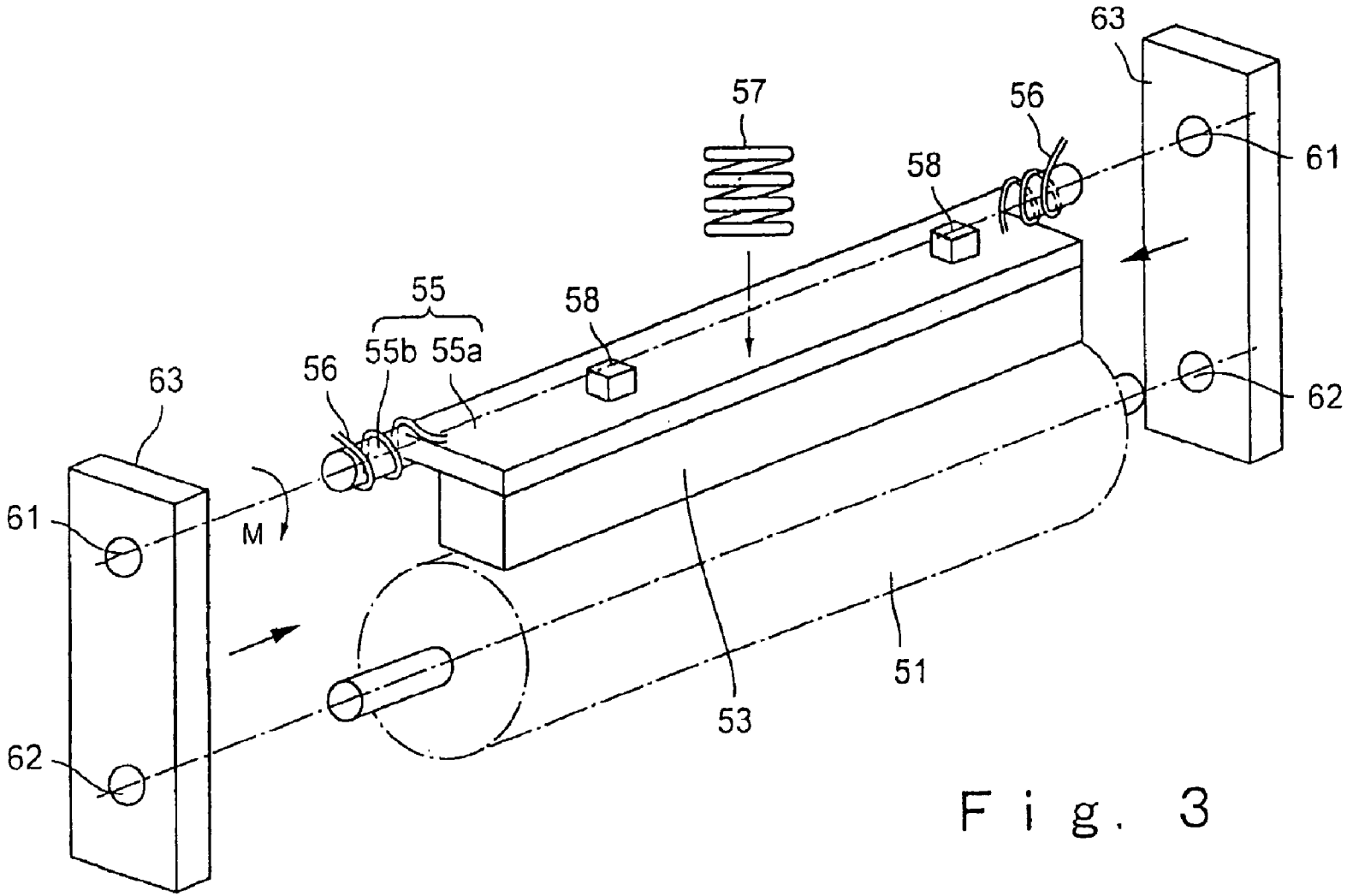
FIG. 3 is an exploded schematic perspective view of the cleaning unit of FIG. 2.

FIG. 3 is an exploded schematic perspective view of the solid lubricant and the support member of FIG. 2.

Referring to FIG. 3, support member 55 has a plate-shaped support section 55*a* and a rotating shaft 55*b* of which both ends extending respectively forward and rearward at the rear side (opposite to the side facing the image carrier 15) of the support section 55*a* and being in parallel with the rotary brush 51. The solid lubricant 53 is fitted to the lower surface of the support member 55*a*. The rotating shaft 55*b* of the support member 55 and the rotary brush 51 are revolvably held in corresponding ones of spindle receiving holes 61 and 62 of bearing members 63 that are fitted to a stationary part of the housing 50 or the like.

With the above described arrangement, movement M is generated around the rotating shaft 55*b* due to the weight of the support section and that of the solid lubricant 53 so that consequently the solid lubricant 53 is brought into contact with the rotary brush 51 under certain pressure. Since the pressure applied to the rotary brush 51 changes as a function of the weight of the support section 55*a* and that of the solid lubricant 53, the contact pressure of the solid lubricant 53 relative to the rotary brush 51 can be held to a predetermined level by appropriately selecting the weights.

As shown in FIG. 2, when the solid lubricant 53 is brought into contact with the rotary brush 51 in order to apply solid lubricant to the image carrier 15, the contact resistance of the cleaning blade 42 can be reduced by driving the rotary brush 51 to revolve at a rate higher than the rate of revolution of the image carrier in the sense indicated by an arrow. Then, the residual toner on the surface of the image carrier 15 is scraped off by the cleaning blade 42. The toner adhering to the rotary brush 51 is removed by a flicker 54 and collected by the toner transporting auger 60.

Since the support member 55 supporting the solid lubricant 53 is prevented from moving in any directions except the peripheral direction by the rotating shaft 55*b*, the extent to which the solid lubricant 53 nips (bites) the rotary brush 51 is always held to a constant level at any part thereof along the axial direction so that solid lubricant 53 is consumed at a constant rate and made to adhere to the rotary brush 51 also at a constant rate in the axial direction. As a result, solid lubricant is applied to the image carrier 15 at a constant rate so that the edge of the cleaning blade 42 will be worn only uniformly and hence can hardly become nicked. Such a cleaning blade 42 can effectively and reliably remove the residual toner on the image carrier 15.

Additionally, since the support member 55 supporting the solid lubricant is adapted to generate movement around the rotating shaft 55*b* by the weight of the support member 55 and the solid lubricant 53 themselves, it is possible to keep the solid lubricant 53 contacting with the rotary brush 51 under predetermined contact pressure due to the movement and prevent the solid lubricant 53 from moving randomly and jumping up and down in response to the rotary movement of the rotary brush 51. Thus, solid lubricant 53 can be supplied on a stable basis for a prolonged period of time due to the constant extent of nip. This advantage of stably supply is particularly remarkable when supplying solid lubricant 53 at a high rate.

When the contact pressure of the solid lubricant 53 relative to the rotary brush 51 needs to be high, the rotating shaft 55*b* of the support member 55 may be provided with a twisted coil spring 56 to structurally increase the movement M as shown in FIG. 3.

Figure 4:
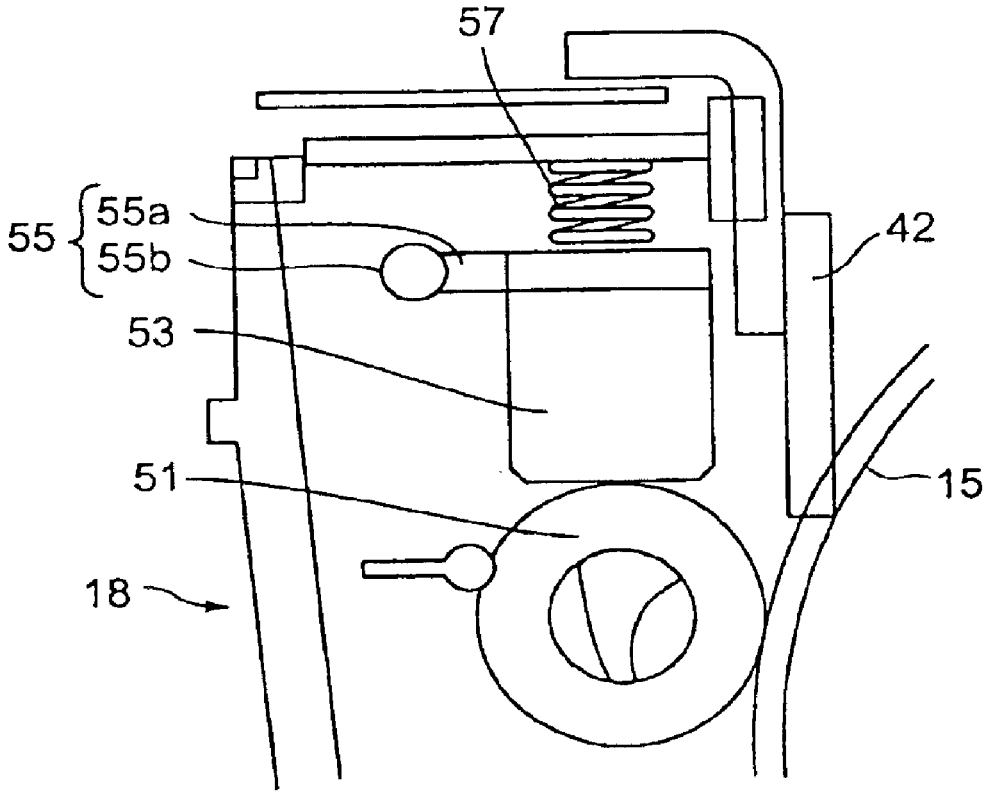
FIG. 4 is a schematic lateral view of the cleaning unit of another embodiment.

As shown in FIGS. 3 and 4, the movement M can also be raised by providing a press spring 57 that presses the support section 55*a* of the support member 55 downward from above.

As shown in FIG. 3, the movement M can also be increased by fitting one or more than one weights 58 onto the support section 55*a* of the support member 55.

Figure 5:
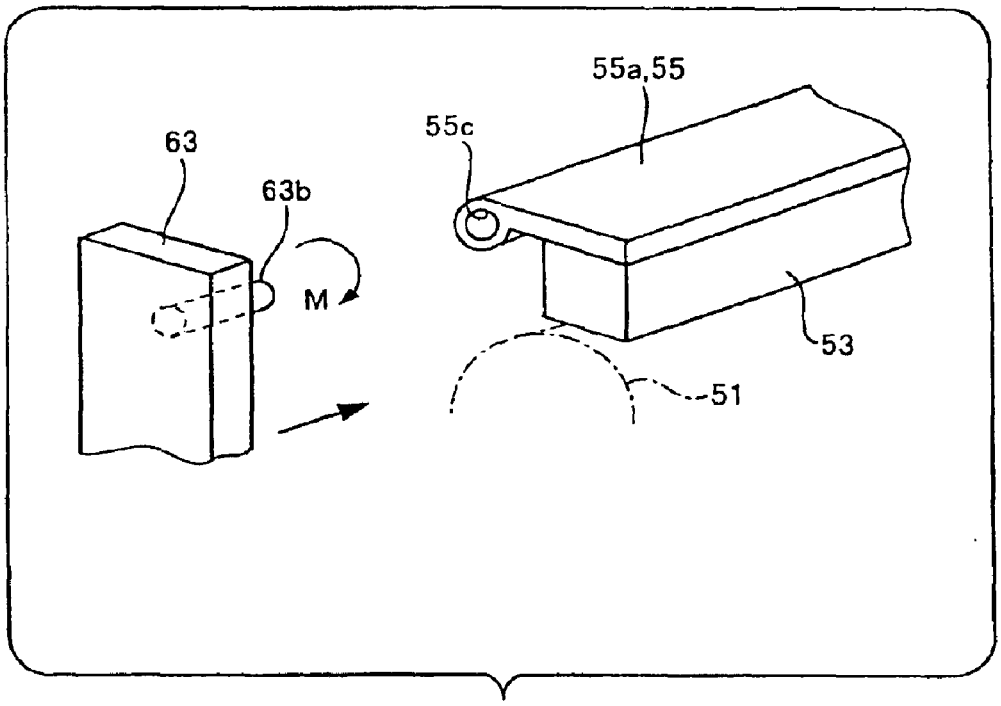
FIG. 5 is an exploded schematic perspective view showing part of a cleaning unit as another embodiment.
Figure 6:
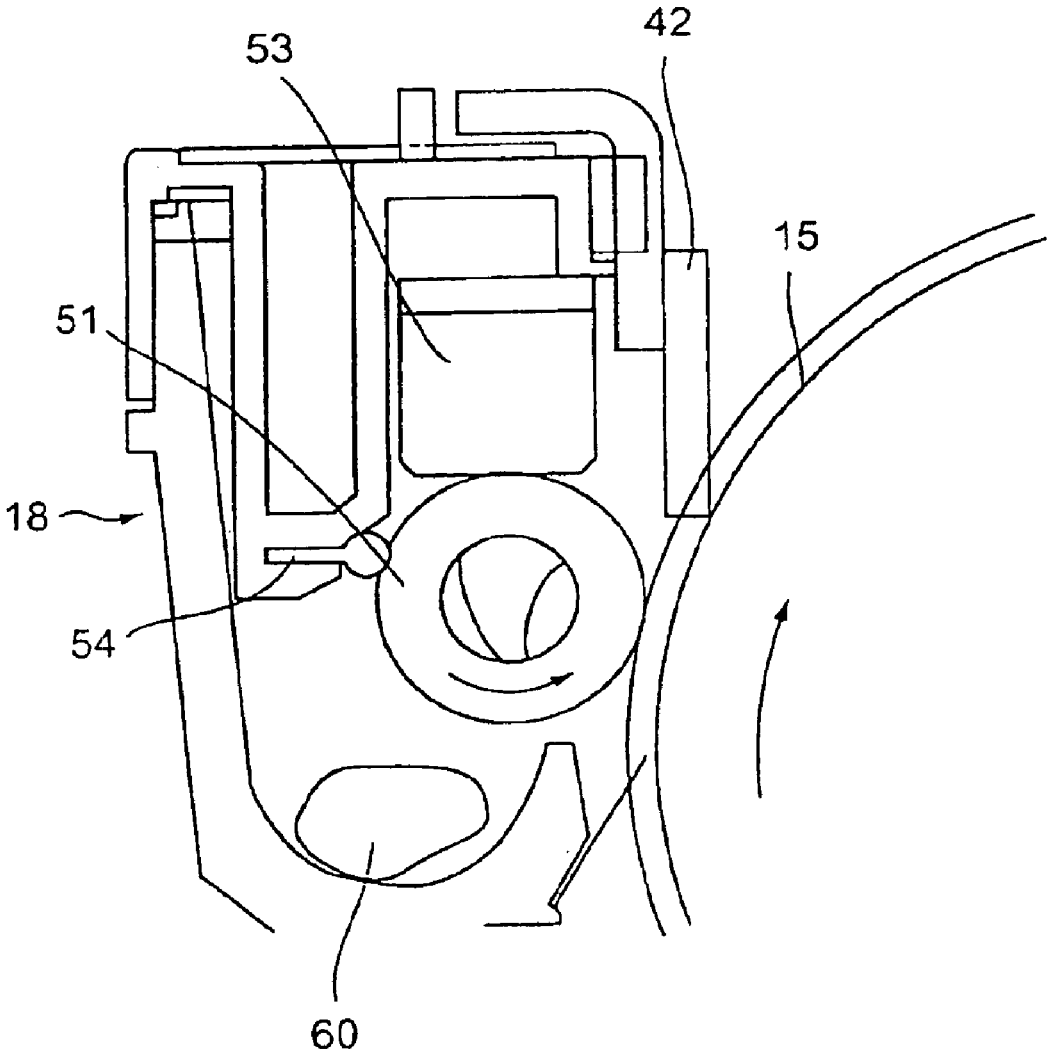
FIG. 6 is a schematic lateral view of the cleaning unit of a known image forming apparatus.
Figure 7:
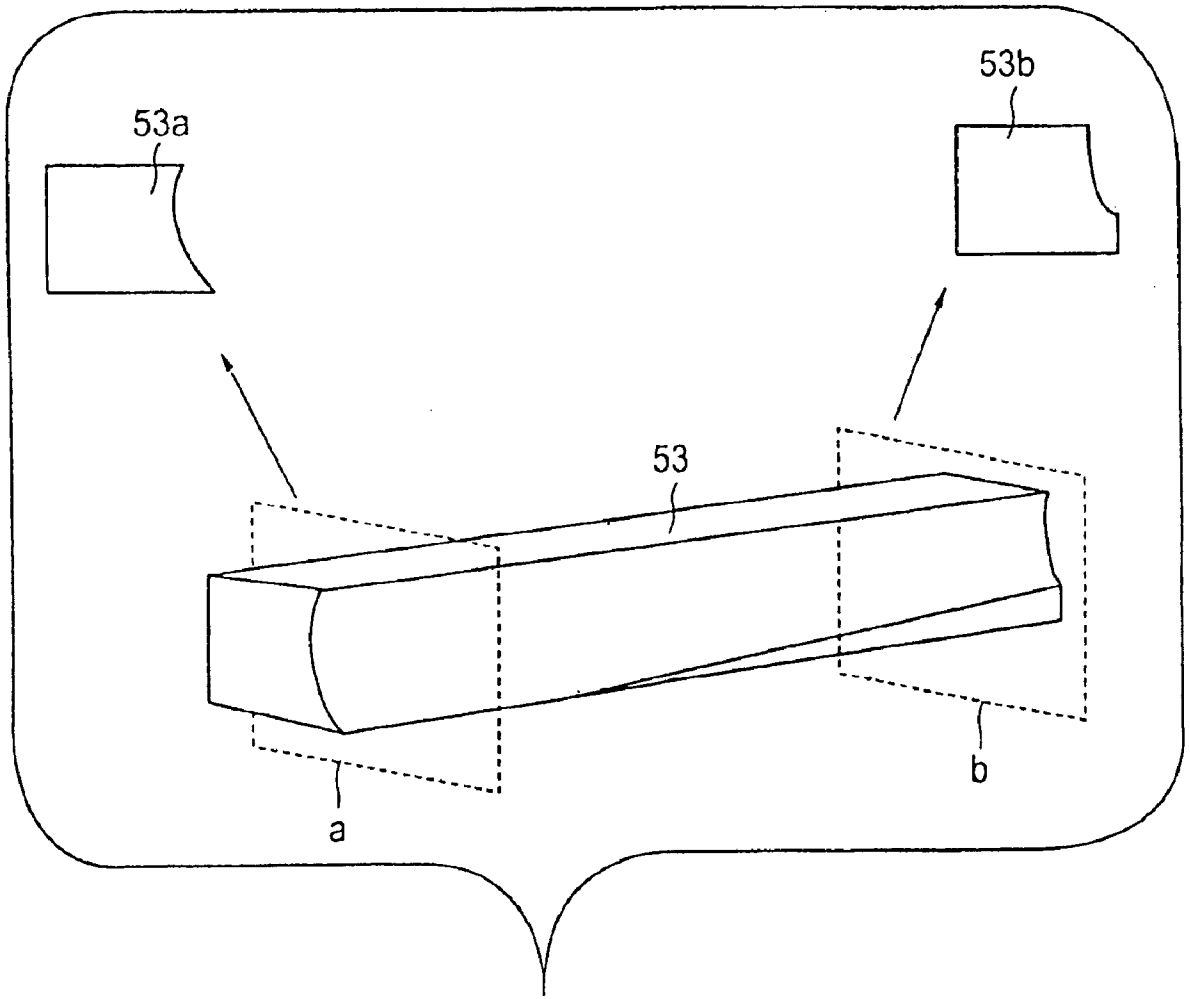
FIG. 7 is schematic perspective view of the solid lubricant arranged in the cleaning unit of FIG. 5, showing that it is worn unevenly.
Figure 8:
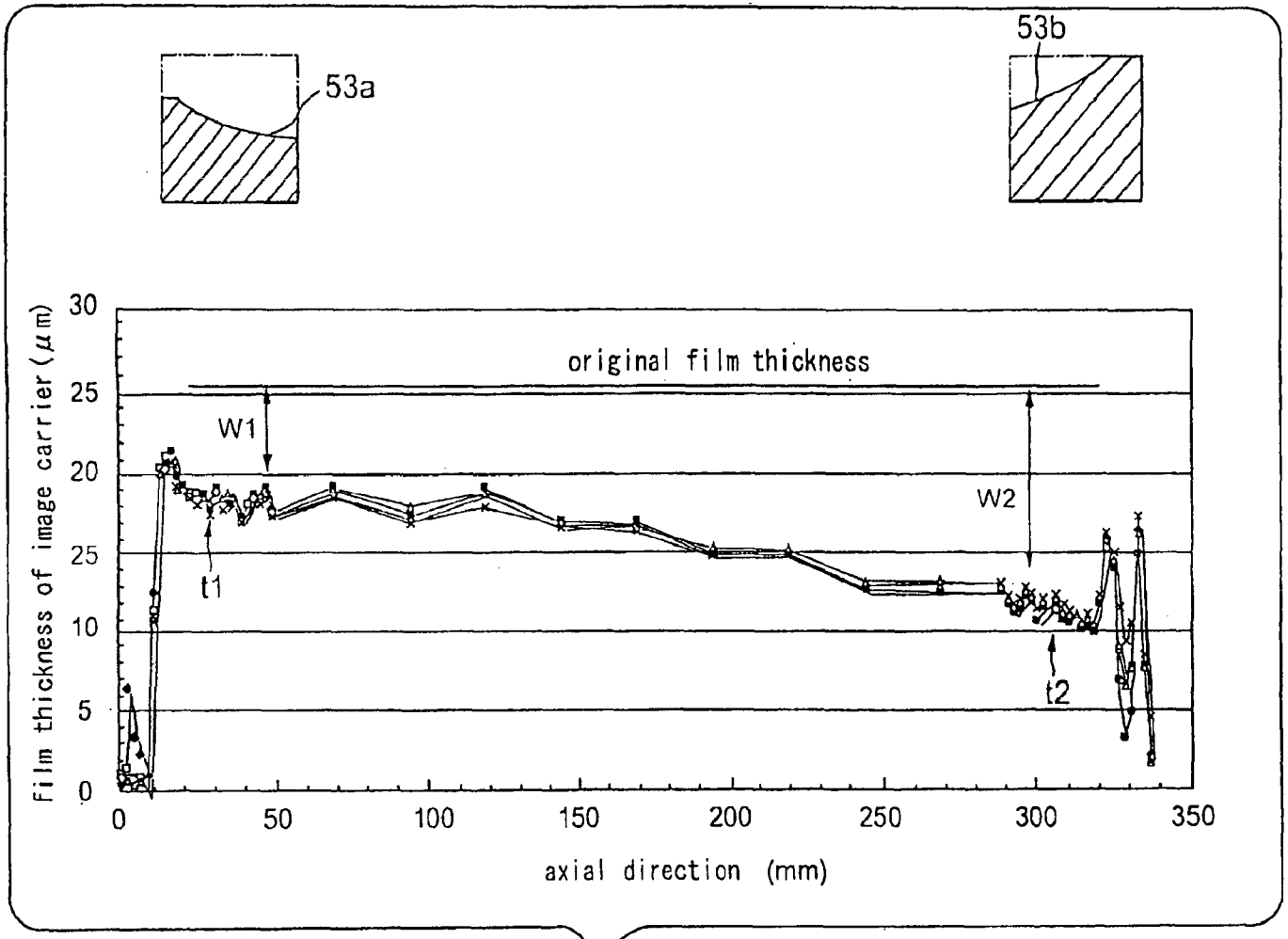
FIG. 8 is a graph illustrating how the film thickness of the image carrier of a known image forming apparatus variably changes due to the use of its cleaning unit.

The rotating shaft 55*b* is arranged at the support section 55*a* in the above embodiment. Alternatively however, as shown in FIG. 5, a rotating shaft 63*b* may be arranged at the stationary side (the bearing member 63 in FIG. 5) and a hole 55*c* may be provided at the support section 55*a*. The hole 55*c* receives and revolvably supports the rotating shaft 63*b*. A similar effect can be obtained in this alternative configuration.

What is claimed is:

1. An image forming apparatus adapted to form a fixed toner image on a recording medium by forming a toner image on an image carrier, transferring the toner image onto the recording medium and fixing the transferred toner image, the apparatus comprising:

a cleaning blade adapted to scrape off the residual toner adhering to the surface of the image carrier;

a brush arranged upstream relative to the cleaning blade in the direction of revolution of the image carrier and adapted to apply solid lubricant to the surface of the image carrier; and a support member for revolvably supporting the solid lubricant and adapted to generate movement, the support member supporting the solid lubricant to come into contact with the brush due to the movement.

2. The image forming apparatus according to claim 1, wherein the support member is revolvably supported by way of a rotating shaft being parallel with the brush.

3. The image forming apparatus according to claim 1, wherein the support member includes:

a plate-shaped support section that supports the solid lubricant; and a rotating shaft being supported by the support section and provided at a position for causing the solid lubricant to generate the movement.

4. The image forming apparatus according to claim 1, wherein the support member supports the solid lubricant to be arranged upstream in the direction of gravity of the brush, and wherein the support member supports the solid lubricant to come into contact with the brush due to the movement generated by the weight of both of the support member and the solid lubricant themselves.

5. The image forming apparatus according to claim 1, wherein the support member supports the solid lubricant and includes a hole being provided at a position for causing the solid lubricant to generate the movement, the hole receiving and revolvably supporting a rotating shaft.

6. The image forming apparatus according to claim 1, wherein the support member is provided with a twisted coil spring in order to increase the movement.

7. The image forming apparatus according to claim 1 wherein a press spring is provided to press the support member so as to increase the movement.

8. The image forming apparatus according to claim 1, wherein a weight is fixed on the support member so as to increase the movement.

9. An image forming apparatus adapted to form a fixed toner image on a recording medium by forming a toner image on an image carrier, transferring the toner image onto the recording medium and fixing the transferred toner image, the apparatus comprising:

cleaning means for scraping off the residual toner adhering to the surface of the image carrier;

lubricant-applying means, being arranged upstream relative to the cleaning means in the direction of revolution of the image carrier, for applying solid lubricant to the surface of the image carrier; and supporting means for revolvably supporting the solid lubricant and adapted to generate movement, the supporting means supporting the solid lubricant to come into contact with the lubricant-applying means due to the movement.

10. The image forming apparatus according to claim 9, wherein the lubricant-applying means has a rotating shaft, and wherein the supporting means is revolvably supported by way of the rotating shaft being parallel with the lubricant-applying means.

11. The image forming apparatus according to claim 9, wherein the supporting means includes:

a plate-shaped support section that supports the solid lubricant and a rotating shaft being supported by the support section and provided at a position for causing the solid lubricant to generate the movement.

12. The image forming apparatus according to claim 9, wherein the supporting means supports the solid lubricant to be arranged upstream in the direction of gravity of the lubricant-applying means, and wherein the supporting means supports the solid lubricant to come into contact with the lubricant-applying means due to the movement generated by the weight of both of the supporting means and the solid lubricant themselves.

13. The image forming apparatus according to claim 9, wherein the supporting means supports the solid lubricant and includes a hole being provided at a position for causing the solid lubricant to generate the movement, the hole receiving and revolvably supporting a rotating shaft.

14. The image forming apparatus according to claim 9, wherein the supporting means is provided with means for increasing the movement.

15. A cleaning unit for applying to an image forming apparatus to form a toner image on a recording medium by forming a toner image on an image carrier, transferring the toner image onto the recording medium comprising:

cleaning means for cleaning the residual toner on the image carrier, said cleaning means contacting the image carrier;

support means having a rotate member for rotating said support means, said support means having a holding member for holding a solid lubricant; and brush means, contacting the solid lubricant and the image carrier, for supplying a piece of the sold lubricant on the image carrier.

16. The cleaning unit according to claim 15, wherein the support means is revolvably supported by way of a rotating shaft being parallel with the brush means.

17. The cleaning unit according to claim 15, wherein the support means includes:

a plate-shaped support section that supports the solid lubricant; and a rotating shaft being supported by the support section and provided at a position for causing the solid lubricant to generate the movement.

18. The cleaning unit according to claim 15 wherein the support means supports the solid lubricant to be arranged upstream in the direction of gravity of the brush means, and wherein the support means supports the solid lubricant to come into contact with the brush means due to the movement generated by the weight of both of the support means and the solid lubricant themselves.

19. The cleaning unit according to claim 15, wherein the support means supports the solid lubricant and includes a hole being provided at a position for causing the solid lubricant to generate the movement, the hole receiving and revolvably supporting a rotating shaft.

20. The cleaning unit according to claim 15, wherein the support means is provided with means for increasing the movement.

* * * * *